US005620826A

United States Patent [19]

Tavernier et al.

[11] Patent Number: 5,620,826

[45] Date of Patent: Apr. 15, 1997

[54] POLYMER SUSPENSION METHOD FOR PRODUCING TONER PARTICLES

[75] Inventors: Serge Tavernier, Lint; Frank Ruttens, Overijse; Bart Van Hove, Niel; Gustaaf Piron, 's Gravenwezel; Theophiel Stuer, Melsele, all of Belgium

[73] Assignee: Agfa-Gevaert, N.V., Mortsel, Belgium

[21] Appl. No.: 570,960

[22] Filed: Dec. 12, 1995

[30] Foreign Application Priority Data

Jan. 30, 1995 [EP] European Pat. Off. ..... 95200216

[51] Int. Cl.[6] ..... G03G 9/087; G03G 9/093

[52] U.S. Cl. ..... 430/137; 430/138; 523/333; 523/339

[58] Field of Search ..... 430/137, 138; 523/333, 339

[56] References Cited

U.S. PATENT DOCUMENTS

| | | | |
|---|---|---|---|
| 4,833,060 | 5/1989 | Nair et al. | 430/137 |
| 4,835,084 | 5/1989 | Nair et al. | 430/137 |
| 5,037,716 | 8/1991 | Moffat | 430/138 X |
| 5,133,992 | 7/1992 | Nair et al. | 427/213.34 |
| 5,298,356 | 3/1994 | Tyagi et al. | 430/137 X |

FOREIGN PATENT DOCUMENTS

| | | | |
|---|---|---|---|
| 5-224462 | 9/1993 | Japan | 430/137 |

*Primary Examiner*—Roland Martin
*Attorney, Agent, or Firm*—Breiner & Breiner

[57] ABSTRACT

A method is provided for producing dry toner particles comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized by the presence in the aqueous phase of a dissolved water-soluble (co)polymer, comprising both hydrophobic and hydrophilic moieties and that II. after evaporation of said solvent said water-soluble (co)polymer is washed away.

36 Claims, No Drawings

POLYMER SUSPENSION METHOD FOR PRODUCING TONER PARTICLES

DESCRIPTION

1. Field of the Invention

This invention relates to a method for the production of powder particles and the use of said particles as toner particles in the development of electrostatic or magnetic patterns or for use in direct electrostatic printing (PEP).

2. Background of the Invention

It is well known in the art of electrophotographic copying or electrographic printing to form an electrostatic latent image corresponding to either the original to be copied, or corresponding to digitized data describing an electronically available image.

in electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light-absorbing particles, called toner particles, which usually are triboelectrically charged.

In direct electrostatic printing (DEP) with dry toner powder the passage of toner particles through an array of micro-apertures of a printhead is controlled electronically and a stream of imagewise modulated toner particles is deposited directly onto a receiver material which can be either the final substrate or an intermediary member wherefrom the toner image is transferred on printing stock, e.g. paper. Several embodiments of DEP are described e.g. in U.S. Pat. Nos. 3,689,935, 4,743,926, 4,912,489, 5,038,322, 5,202,704, GB-P 2,108,432, DE-OS 3,411,948, published EP-A 266 960, and by Murata et al., in a paper presented at the Int. Conf. Applied Electrostatics (Bejing—China), 1993, p. 391–411.

In magnetography a latent magnetic image is formed in a magnetizable substrate by a patternwise modulated magnetic field. The magnetizable substrate must accept and hold the magnetic field pattern required for toner development which proceeds with magnetically attractable toner particles.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, Apr. 1972, pp.495–511. The application of mono-component magnetic and nonmagnetic toner may proceed advantageously by brush or in a brush-like form.

In DEP operating with dry toner the toner particles may be applied as mono-component toner or may be transferred from a brush of magnetic carrier particles as disclosed in EP-A 675 417.

In most cases the finely divided toner material forming a powder image is transferred from the image-forming substrate onto a final support sheet such as paper.

In order to get a high quality hard copy or print the developer must meet stringent requirements. It is for example important that the toner particles have a small average particle size and that the particle size distribution is narrow.

The use of toners with small average particle size makes it possible to achieve high resolution in the final image. In PCT/EP 90/01027 it is taught how the reduction in average particle size of the toner particles from 11.3 μm to 4.5 μm improves the image resolution.

A narrow particle size distribution of carrier and toner particles makes it easier to achieve a homogeneous spread of the electrical and/or magnetical properties over these particles. By homogeneous spread is understood that each particle has the same electrical and magnetical properties regardless of its size. When the electrical and magnetical properties of the carrier particles and of the toner particles are homogenously spread over all the particles, then the behaviour of all particles is the same during the copying or printing process resulting in high quality copies or prints.

In addition to said desired small average particle size and narrow size distribution, the shape of the toner particles is important for obtaining a high quality imaging system especially in fine detail (dot) printing. An identical shape, preferably substantially spherical shape, is in favor of reproducible triboelectric charging and good toner powder flowability which results in reproducible development results. A smooth toner powder surface is preferred for equal charge distribution.

Although there are many processes to produce toner particles, few produce such toner particles showing a substantially spherical shape and a narrow particle size distribution.

If the production process itself does not yield a narrow size distribution, the toner particles have to be sized through classification. The efficiency of this classification process is strongly determined by particle size. The smaller the particle size the less efficient the classification process. Toner particles with an average size of less than 5 μm and narrow size distribution are difficult to obtain and present a high production cost.

There are basically two preparation methods known that directly yield spherically shaped polymer-containing toner particles with a narrow particle size distribution, thus avoiding the expensive classification step. These methods are "emulsion polymerization" sometimes called "suspension polymerization" —and the "polymer suspension" process.

The "emulsion polymerization" process, limited to the production of addition polymers, is described e.g. in U.S. Pat. No. 2,932,629, U.S. Pat. No. 4,148,741, U.S. Pat. No. 4,314,932 and EP-A 255 716. In this process a water-immiscible polymerizable liquid is sheared to form small droplets emulsified in an aqueous solution, and the polymerization of the monomer droplets takes place in the presence of an emulsifying agent. Initially the polymerizable monomers are in liquid form and only at the end of the polymerization a suspension of solid polymer particles in the aqueous phase is obtained.

In the "polymer suspension" process a pre-formed polymer is dissolved in an appropriate organic solvent that is immiscible with water, the resulting solution is dispersed in an aqueous medium that contains a stabilizer, the organic solvent is evaporated and the resulting particles are dried.

The "polymer suspension" process has an advantage over "emulsion polymerization" because any polymer, known for toner preparation can be used. The "polymer suspension"

process can proceed with addition polymers as well as with polycondensation polymers, whereas the "emulsion polymerization" process is, inherently, restricted to the use of addition polymerizable monomers.

In the "polymer suspension" process the droplets of the solution of the polymer in an organic solvent have to be stabilized in an aqueous medium. Silica particles can be used as dispersion (suspension) stabilizer as described in U.S. Pat. No. 4,833,060 and corresponding EP-A 334 095, where silica particles and a promoter are used to stabilize the suspension. After evaporation of the solvent, however, the silica particles stay adsorbed to the toner particles and thus impart hydrophilicity to the toner particles and under high humidity conditions may reduce the chargeability of the toner particles. In U.S. Pat. No. 5,298,356 it is described, in column 9 lines 21 to 52, that the stabilizing of a "polymer suspension" can be achieved by using a particulate stabilizer (cross-linked latices or silica) in combination with a promoter being e.g. a polymer carrying sulphonate groups.

In U.S. Pat. No. 4,835,084 it is described that the removal of the silica particles from the surface of the toner particles can best be carried out by washing the particles with a strong alkaline solution. The use of strong alkaline solutions in itself can pose problems with regard to safety and ecology and the strong alkaline solution can react with some resins (e.g. linear polyester resins) which are particularly useful toner resins.

To avoid that washing step it has been proposed in U.S. Pat. No. 5,133,992 and corresponding EP-A 334 126 to stabilize the droplets of the dispersion of the polymer solution in aqueous medium with solid copolymer particles (without silica and without any non-solid polymer promoter) that control the size and size distribution of the final polymer particles stemming from said droplets.

The stabilizing solid polymer particles (being non-solubale in water) consist of a copolymer of:

(1) about 25 to about 80 percent by weight, based on total monomer weight, of an addition polymerizable non-ionic oleophilic monomer;

(2) about 5 to about 45 percent by weight, based on total monomer weight, of an addition polymerizable non-ionic hydrophilic monomer;

(3) about 1 to about 50 percent by weight, based on total monomer weight, of an addition polymerizable ionic monomer; and (4) about 1 to about 50 percent by weight, based on total monomer weight, of a crosslinking monomer having at least two addition polymerizable groups. After evaporating the organic solvent the solid (small) copolymer particles stay attached to the surface of the toner particles.

By a judicious choice of the monomers it is possible not only to stabilize the dispersion of dissolved toner-resin polymer by said solid copolymer particles but also to provide desired surface properties to the toner particles.

Although this process has advantages over the stabilization by silica particles, the degrees of freedom in the composition of the copolymer that is used are limited by the fact that the solid copolymer particles, used as dispersion stabilizer, have to be sufficiently hydrophilic in order to be dispersable in water but must remain oleophilic enough to be attached to the oleophilic droplets for keeping them stabilized in dispersion. Moreover, the oleophilicity of the solid copolymer particles should be kept sufficiently low for preventing the stabilizing copolymer particles to become dissolved in the oleophilic droplets containing the dissolved toner-resin polymer.

The "polymer suspension" process for making toner particles with narrow particle size distribution would find more applications when the droplets of the solution of the polymer in an organic solvent could be stabilized in an aqueous medium with a stabilizer that, when necessary can be washed away easily or that, when it is desired to fine tune surface properties of the toner particles, can easily be modified and permanently deposited onto the surface of the toner particles.

3. Objects and Summary of the Invention

It is an object of the present invention to provide a convenient method for producing toner particles with a small average particle size, narrow size distribution and substantially spherical shape.

It is another object of the present invention to provide a method for producing toner particles with a small average particle size, narrow size distribution and substantially spherical shape, wherein the toner resin can be an addition polymer as well as a polycondensation polymer.

It is a further object of the invention to provide toner particles that can be used as core particles in toner particles with core-shell structure and that easily can be covered with a polymeric shell.

It is a further object of the invention to provide a method for producing toner particles with a small average particle size, narrow size distribution and substantially spherical shape in an "polymer suspension" process, wherein no silica is used to stabilize the polymer suspension and the stabilizer, used to stabilize the polymer suspension, is water-soluble.

Other objects and advantages of the present invention will follow from the further description.

In accordance with the present invention a method is provided for producing dry toner particles comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized, in the absence of silica, by the presence in the said aqueous phase of a dissolved water-soluble (co)polymer, comprising both hydrophobic and hydrophilic moieties and that II. after evaporation of said solvent said water-soluble (co)polymer is washed away.

In a preferred embodiment said water-soluble (co)polymer comprises either carboxyl or sulphonic acid groups or both in acid or salt form.

In a further preferred embodiment said water-soluble (co)polymer is a (co)polymer of at least one addition polymerizable hydrophobic monomer and at least one addition polymerizable ionic monomer.

In a further preferred embodiment said ware-soluble (co)polymer comprises at least one carboxyl group in the form of an ammonium salt or in the form of the salt of a lower alkyl tertiair amine.

Throughout the whole of this document the terminology "water-immiscible solvent" has to be understood as a solvent that is insoluble in water at 20° C. or dissolves therein at that temperature for no more than 10 g per 100 ml of water.

The terminology "water-insoluble substance" has to be understood a substance that is less than 5 g soluble in water at 20° C.

The glass transition temperature (Tg) has always been determined according to ASTM Designation: D 3418-82.

The softening temperature mentioned has been determined according to the well known ring and ball method.

4. Detailed Description of the Invention

The Water-Soluble (Co)Polymer

The use of a dissolved water-soluble (co)polymer, comprising both hydrophobic and hydrophilic moieties as dispersion-stabilizer offers the advantage that after evaporation of the organic solvent said (co)polymer can be washed away easily with water without need of chemically corrosive liquids.

By the proper choice of said water-soluble (co)polymer it is possible to make use of a simple change in the composition of the aqueous medium to influence its behaviour, e.g. dispersion power, and to control its adherence to the dispersed droplets and afterwards desorption so that it can be easily washed away once the polymeric core particles are formed. Said change can be a change in pH or change in ion-content whereby salting out effects can be obtained. It is possible to use the stabilizing water-soluble (co)polymer as a kind of charge controlling agent when the stabilizing (co)polymer is not washed away, but is precipitated onto the formed polymer particles. By a proper choice of water-soluble stabilizing (co)polymer (e.g. choosing the right balance between hydrophilic and hydrophobic moieties, the right balance between amount of sulphonic acid groups and carboxylic acid groups, etc.) the triboelectric chargeability of the particles can be controlled by precipitating the water-soluble stabilizing (co)polymer onto the particles.

Both polycondensation (co)polymers and addition (co)polymers are useful water-soluble stabilizing (co)polymers, for use according to the present invention.

Very useful polycondensation polymers are (co)polyesters, comprising sulphonic acid groups or carboxyl groups. Non-limitative examples of very useful (co)polyesters are:

- a polyester comprising terephthalic acid moieties, isophthalic acid moieties and at least 20% by weight (with respect to the total dicarboxylic acid content) of 5-sulfoisophthalic acid moieties and as diol component ethylene glycol moieties
- a polyester comprising bis-alkoxylated bisphenol A moieties, optionally ethylene glycol moieties, fumaric acid moieties and at least 20% by weight (with respect to the total dicarboxylic acid content) of 5-sulfoisophthalic acid moieties
- a polyester comprising bis-alkoxylated bisphenol A moieties, ethylene glycol moieties, between 30 and 60% by weight of terephthalic acid moieties and between 70 and 40% by weight of trimellitic acid moieties. The percentages of acid are given with respect to the total acid content. The condensation reaction is carried out at such a reaction temperature that the sterically hindered carboxyl group of the trimellitic acid does not or only partially take part in the reaction. In that way the finished (co)polyester comprises free carboxylic acid groups.

it is also possible to use polyesters comprising other acid moieties than terephthalic acid moieties: e.g. it is possible to use fumaric acid, sebasic acid, adipic acid etc.

Water-soluble (co)polymers being particularly suitable stabilizers for use in the toner preparation method of the present invention are addition (co)polymers of at least one hydrophobic monomer, e.g. styrene and an alkyl(meth)acrylate that are addition-polymerized with at least one addition polymerizable ionic monomer. This ionic monomer, for forming the stabilizing water soluble (co)polymer according to the present invention, is preferably an ethylenically unsaturated mono- or dicarboxylic acid or anhydride. In the production of stabilizing water-soluble (co)polymers, for use according to the present invention, it is preferred to use acrylic acid, methacrylic acid and crotonic acid as ethylenically unsaturated mono-carboxylic acids. When dicarboxylic acids are used in the production of stabilizing a water-soluble (co)polymer, for use according to the present invention, it is preferred to use maleic acid, fumaric acid, itaconic acid and citraconic acid as well as half-esters and half-amides of these dicarboxylic acids.

Before use it is preferred that the carboxylic acid or sulfonic acid groups, of both the polyesters and the addition (co)polymers to be used as stabilizing (co)polymer according to the present invention, are transformed in a corresponding water-soluble salt group e.g. alkali metal salt or more preferably an onium salt, said onium salt being most preferably either an ammonium or a tertiair ammonium salt. Before, at least partial, transformation into ammonium salt the acidic (co)polymers, both polycondensation and addition (co)polymers, have preferably a total acid number in the range of 50 to 500.

By "total acid number" is understood the quantity of base expressed in milligrams of potassium hydroxide, that is required to neutralize all acidic constituents in 1 g of sample (ref. ASTM D 664-58).

Suitable addition (co)polymers to be used as stabilizer (co)polymers in a method according to the present invention and transformed in their ammonium salt, are co(styrene/acrylic acid), co(styrene/ethylmaleate/maleic acid); co(styrene/n-butylmaleate/maleic acid), co(vinylacetate/crotonic acid), and co(vinylacetate/crotonic acid/methylmethacrylate).

Particularly preferred stabilizer (co)polymers are copolymers of vinyl acetate and crotonic acid (90/10 by weight) having a total acid number of 50 to 300, and copolymers of styrene and maleic acid anhydride having a total acid number of 250 to 500, both said copolymers being used, at least partially, transformed into their ammonium salt form. The most preferred water soluble (co)polymer for use as stabilizer for a polymer suspension according to the present invention is a styrene/ammoniummaleinate copolymer, particularly the copolymer showing a 50/50 mole ratio of styrene and ammoniummaleinate.

The concentration of stabilizer (co)polymer in the aqueous medium containing the droplets of organic polymer(s) dissolved in the organic water-immiscible solvent may vary widely but is e.g. in the range of 0.5 and 20% by weight (w/w) on the total liquid composition, although it is preferred that the stabilizing (co)polymer is present in the range of 1 to 10% (w/w).

The advantage of the use of water-soluble polymers to stabilize the small droplets of toner resin in a water immiscible solvent lays in the fact that it can stabilize the suspension of the droplets in the absence of particulate stabilizers, as e.g. cross-linked polymer particles or silica. The use of water-soluble polymers as stabilizers provides more degrees of freedom in adapting the surface of the toner particles to a specific use, than the use of particulate stabilizing materials.

The Water-Immiscible Organic Solvent

The organic water-immiscible solvent for dissolving said organic toner-resin polymers should have a high volatility so that it can readily be removed from the discontinuous phase droplets by evaporation. Such solvents are e.g. chloromethane, dichloromethane, trichloromethane, ethylene chloride, ethyl acetate, etc. or mixtures thereof.

For ecological reasons in the "polymer suspension" process of the present invention preferably toner-resin polymers are used that are soluble in ethyl acetate that has a boiling point of : 77.15° C. at normal atmospheric pressure and is slightly miscible with water in that it can be dissolved for 8.6 g in 100 ml of water at 20° C.

The Toner Resin

The method of the present invention, i.e. toner preparation by the "polymer suspension" process wherein the droplets of the solution of a polymer (toner resin) are stabilized by a water soluble (co)polymer as defined above, is particularly well suited for making toner particles comprising at least one polycondensation polymer as toner resin and showing a narrow particle size distribution without the need for further classification of the particles. Polycondensation polymers useful as toner resins are polyesters, polyurethanes, polyamides, polycarbonates, epoxy resins and the like.

Examples of useful polyesters are described e.g. in U.S. Pat. No. 3,590,000; U.S. Pat. No. 3,681,106; U.S. Pat. No. ,657,837, EP-A 495 475 and EP-A 601 235.

Polyester resins have normally an outspoken negative triboelectric chargeability and are therefore normally used for the production of triboelectrically negatively chargeable toners either alone or in the presence of a negative charge controlling agent, e.g. CCA 7 being a Cr(III) complex having the structure given on page 159 of the already mentioned book "Chemical Technology in Printing and Imaging Systems". Polyester resins obtain a considerable negative triboelectric chargeability through the presence of free carboxyl groups or acid anhydride groups.

In the production of triboelectrically positively chargeable toners polyester resins may be used in combination with a positive CCA, e.g. a black nigrosine salt or colorless quaternary ammonium salt such as cetylpyridinium chloride (see page 160 of the above mentioned book).

Particularly suitable polyesters for use as binder for toner particles prepared according to the present invention are linear polycondensation products of (i) difunctional organic acids, e.g. maleic acid, fumaric acid, terephthalic acid and isophthalic acid and (ii) difunctional alcohols such as ethylene glycol, triethylene glycol, an aromatic dihydroxy compound, preferably a bisphenol such as 2,2-bis(4-hydroxyphenyl)-propane called "bisphenol A" or an alkoxylated bisphenol, e.g. propoxylated bisphenol examples of which are given in U.S. Pat. No. 4,331,755. For the preparation of such polyester resins reference is made to GB-P 1,373,220.

A preferred example of said polyesters is a linear polyester of fumaric acid and bis-propoxylated bisphenol A, having a melt viscosity of 180 Pa.s and a glass transition temperature (Tg) of about 50° C. Such a linear polyester is commercially available under the tradename ATLAC T500 (ATLAC is a registered tradename of Atlas Chemical Industries Inc. Wilmington, Del. U.S.A.).

It may be advantageous for preparing toners suited for fixing by infra-red radiation to control the glass transition temperature and melting point to use therefor a mixture of polyesters or of an epoxy resin and at least one polyester as disclosed in EP-A 601 235, that is incorporated by reference.

Preferably applied epoxy resins are linear adducts of bisphenol compounds and epichlorhydrin as described e.g. by D. H. Solomon in the book "The Chemistry of Organic Film Formers"—John Wiley & Sons, Inc, New York (1967) p. 180–181, e.g. EPIKOTE 1004 (EPIKOTE is a registered trade mark of the Shell Chemical Co).

In the preparation of toner particles according to the present invention also addition homo- or copolymers of olefinic or acrylic monomers or mixtures that can be dissolved in water-immiscible solvent(s) can be used as toner resin. Examples of such polymers serving as toner-ingredient binders can be found e.g. in U.S. Pat. No. 3,933,665 and U.S. Pat. No. 4,833,060.

Toner-resins may have inherently already a high triboelectrical chargeability.

For example, toner-resins that have good inherent positive triboelectrostatic chargeability are silicone resins (see the triboelectric series given in the article "Physics of Electrophotography" in PHYSICS TODAY, May 1986, p. 51.

Highly positively triboelectrically chargeable resins other than silicones are polymers containing amino groups and such polymers in which the amino groups wholly or partly are transformed into onium groups being organic cationic groups. Monomers containing amino groups for preparing such resins by addition polymerization are described e.g. in U.S. Pat. No. 4,663,265.

Particularly useful positively chargeable resins are listed by No. in the following Table 1. Of these resins their number-average molecular weight (Fin) and weight-average molecular weight (Mw) is given. The mentioned Fin and Mw values have to be multiplied by $10^3$.

TABLE 1

| No. | Chemical structure | Mn | Mw |
|---|---|---|---|
| 1 | Terpolymer of styrene, 2-ethylhexyl-methacrylate, dimethylaminoethylmethacrylate (79/20/1 by weight) | 9 | 24.1 |
| 2 | Copolymer of styrene and dimethylamino-ethylmethacrylate (85/15 by weight) | 3.8 | 13.3 |

By the high triboelectric positive charging capability of said resin(s) applied in toner particles prepared according to the present invention further positive charge inducing substances have not to be used. The presence of said resins provides already a strong positive net charge (q) represented by a high q/d (d represents average particle size) and wherein the q/d distribution in a bulk of toner particles is very narrow and wrong sign (positive) toner particles are practically absent.

On applying the method according to this invention, the concentration of the toner-resin in the water-immiscible solvent may range from 5 to 50% by weight, preferably the concentration ranges between 10 and 30% by weight.

The method according to the present invention makes it possible to produce toner particles wherein the average size of the particles (on weight base) is between 3 μm and 10 μm. The particle size distribution of the toner particles, prepared according to the present invention is basically normal, with possibly a positive skewness, and the variation coefficient of the distribution (standard deviation/average particle size) is lower than 0.4, preferably lower than 0.3.

Toner Ingredients

The method according to the present invention can be used to produce colourless as well as coloured (pigmented or dyed) toner particles.

Various addenda which are normally present in electrographic toner particles can be dissolved or dispersed in the organic solution of the toner-resin, such as a colorant selected from a wide variety of dyestuffs and pigments and charge controlling agents (CCA's).

The ingredients, coloring agents as well as charging agents, have to be selected properly so as to remain in the dispersed phase, i.e. in the polymer-containing droplets, and not to diffuse into the aqueous phase or accumulate in the interface of organic droplets and the aqueous medium. Therefore, preferred are oleophilic ingredients or ingredients that can be oleophilized or hydrophobized by e.g. reaction with organophilic coupling agents such as fluorine-containing silane compounds as described e.g. in U.S. Pat. No. 4,973,540. Other oleophilization agents are silanes and titanates described in same U.S. Patent. Using such compounds reactive hydrophilic groups of the chosen ingredients form reactive sites whereto oleophilizing groups are attached. Optionally the selected ingredients are first enveloped or coated with an oleophilic substance, e.g. a wax, perfluoro acid, fatty acid or derivatives thereof. It is also possible to add (disperse) polymeric particles, that have affinity for the organic solvent in which the toner resin is dissolved but do not (completely) dissolve in said solvent, in the solution wherein the toner resin is dissolved. Said polymeric particles can be composed of the same resin as the toner resin as well as one or more different resins.

Different categories of toner ingredients will be discussed hereinafter more in detail.

Useful CCA's are disclosed e.g. in U.S. Pat. No. 4,263,389 U.S. Pat. No. 4,264,702 and WO 92/18908. These CCA's are present in low concentrations, ranging from 0.1 to 0.3% by weight, preferably from 0.2 to 1.5% by weight on the total toner weight.

Common toner compositions are colored although colorless toner particles may be used to control e.g. the gloss and/or mechanical resistance of fixed toner images (ref. e.g. published EP-A 486 235 and EP-A 081 887). Typical colorants and CCA's are disclosed in "Chemical Technology in Printing and Imaging Systems" edited by J.A.G. Drake—The Royal Society of Chemistry—Thomas Graham House, Science Park, Cambridge U.K. (1993), p.154–161.

For producing visible images the toner particles contain in the resinous binder a colorant which may be black or has a color of the visible spectrum, not excluding however the presence of infra-red or ultra-violet absorbing substances and substances that produce black in admixture.

In black-and-white copying the colorant is usually an inorganic pigment which is preferably carbon black, but is likewise e.g. black iron (III) oxide. Inorganic coloured pigments are e.g. copper (II) oxide and chromium (III) oxide powder, milori blue, ultramarine cobaltblue and barium permanganate.

Examples of carbon black are lamp black, channel black and furnace black e.g. SPEZIALSCHWARZ IV (trade name of Degussa Frankfurt/M—Germany) and VULCAN XC 72 and CABOT REGAL 400 (trade names of Cabot Corp. High Street 125, Boston, U.S.A.).

The characteristics of a preferred carbon black are listed in EP-A 601 235, which is incorporated by reference.

In order to obtain toner particles having magnetic properties a magnetic or magnetizable material in finely divided state is dispersed into the organic water-immiscible solvent containing the dissolved toner-resin polymer(s).

The coloring pigments such as carbon black as well as the magnetic pigments may be precoated with an oleophilizing substance or have been reacted therewith as is the case for a magnetic iron oxide that through free hydroxyl groups can be linked to the above discussed-silane oleophilizing agents and organic isocyanates.

Suitable substances having magnetic character or obtaining such property are e.g. magnetizable metals including iron, cobalt, nickel and various magnetizable oxides, e.g. heamatite ($Fe_2O_3$), magnetite ($Fe_3O_4$), $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of these.

In black toners organic colored black dyes may replace partially or wholly carbon black, e.g. use is made of nigrosine type dyes that at the same time have positive charge control properties (ref. the above mentioned book "Chemical Technology in Printing and Imaging systems" p. 160 and U.S. Pat. No. 4,525,445)

Toners for the production of color images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York, U.S.A (1950).

Likewise may be used the dyestuffs described in EP-A 384 040, EP-A 393 252, EP-A 400 706, EP-A 384 990 and EP-A 394 563.

Examples of particularly suited organic dyes are listed according to their color yellow, magenta or cyan and are identified by name and Colour Index number (C.I. number) in EP-A 601 235, which is incorporated by reference.

In order to obtain toner particles with sufficient optical density in the spectral absorption region of the colorant, the colorant is preferably present therein in an amount of at least 1% by weight with respect to the total toner composition, more preferably in an amount of 1 to 10% by weight.

The dispersing of the toner-resin solution in the aqueous solution of water-soluble (co)polymer-stabilizer proceeds in an agitation device to yield fine droplets of the toner-resin(s) dissolved in the water-immiscible solvent. Any type of high shear type agitation device such as a colloid mill containing a fast rotating rotor in small mixing interspace can be used, or the suspension can be formed by ultrasonic agitation as described in EP-A255 716.

After emulsifying the solvent is evaporated, preferably under reduced pressure and fairly low temperature, so as to leave solid polymer particles with the stabilizer (co)polymer adsorbed thereon.

The stabilizer (co)polymer is removed on separating the solids from the liquid phase, e.g. by centrifuging, and washing the solid particles with water and centrifuging and removing liquid again. This procedure is repeated until all of the stabilizer (co)polymer is washed away. Normally said procedure is repeated four times. A change of the pH may assist in an easier washing away of the stabilizer (co)polymer, that comprises acidic groups. For example, an increase in pH to 8 has been found advantageous, preferably by adding ammonium hydroxide or introducing $NH_3$ gas into the aqueous phase. Volatile basic substances can be easily removed in the drying stage. After the last wash the polymer particles are separated and dried and may be used as such as electrostatographic or magnetographic toner having their final composition and triboelectric chargeability. When all stabilizing agent is washed away, the chargeability of the toner particles prepared according to the present invention is the same as the chargeability of toner particles (comprising the same toner resin and ingredients) made by the classical melt-kneading, crushing and classification process.

The method according to the present invention is also very suitable to produce core particles that will be used to form core-shell toner particles. The method of the present invention, i.e. toner preparation by the "polymer suspension" process wherein the droplets of the solution of a polymer (toner resin) are stabilized by a water soluble (co)polymer as defined above, is particularly well suited for making spherical core particles comprising at least one polycondensation polymer as toner resin. Since all stabilizer has been washed away, there is between core and shell no third polymeric substance present. Therefore it is easier to fine-tune the properties (dielectric, melting, hardness, etc) of core-shell toner particles using core particles prepared according to the present invention.

It is also much easier to ensure a proper binding of the shell to the core in the absence of a third polymeric substance of partially different hydrophobicity than the surface of the core. In the "polymer suspension" process for making core particles the (polymeric) stabilizing agent is hydrophilic and the core polymer hydrophobic. When then the stabilizer is not totally washed away, a core with ambiguous surface properties is obtained: on the spots of the core surface still covered with stabilizer the surface is hydrophilic and the other spots of the surface are hydrophobic. This ambiguity in surface properties diminishes the compatibilty with and bonding strength of a shell polymer to said core.

Another approach, for using the particles produced according to the present invention as "core"-particles in "core-shell"-particles, is to convert the stabilizer and/or precipitate the stabilizer totally onto said the core particle and thus forming particles with unambiguous surface properties (the surface totally covered with stabilizer). These particles can be used as such or as new core particles for further formation of core-shell particles.

It is possible to precipitate (partially or totally) the stabilizing water-soluble (co)polymer on the surface of the (core) particles, prepared with the method according to the present invention and thus modify the surface properties of the particles.

The water-soluble stabilizing (co)polymer is precipitated on to the particles, produced by the method according to this invention, by chemical reaction, e.g. acidification of the aqueous medium, the water-soluble (co)polymer adhering to the dispersed polymer particles can be transformed into a water-insoluble species that precipitates on the particles and gives dried toner particles with different properties than when the water-soluble stabilizing (co)polymer is washed away. Such can be done easily by acidifying (changing the pH of) an ammonium carboxylate containing (co)polymer in which the ammonium ion on acidification is replaced by hydrogen so that poorly ionizable —COOH groups giving rise to negative triboelectric chargeability are formed. Onium ions other than ammonium undergo a similar transformation. In the case above a combination of conversion and precipitation is used.

A selection of water-soluble (co)polymers containing onium groups in the polymer backbone may be used to form on alkalinization (on changing the pH) poorly water-soluble polymers having amino-groups that may stand in equilibrium with a certain amount of hydroxyl ($HO^-$) groups and give rise to positive triboelectric chargeability.

It is also possible, instead of precipitating the water-soluble (co)polymer by changing the pH, to precipitate said water-soluble stabilizing (co)polymer onto the core particles by addition of multi-valent cations, e.g. $Ca^{2+}$, $Zn^{2+}$, $Al^{3+}$, etc The precipitation of said water-soluble (co)polymer onto the core particles can also processed by the addition of multi-valent organic cations, e.g. dionium ions.

When it is intended to precipitate the water-soluble stabilizing (co)polymer onto the formed core particles, the same water-soluble stabilizing polymers as described hereinbefore can be used.

The method according to the present invention is, as indicated above, also well suited to form particles with a clean surface with unambiguous surface properties. Therefor the water-soluble stabilizer (co)polymer can be washed away (leaving "naked" core particles), and a shell of another polymer, with e.g. a more hydrophobic character and better triboelectric chargeability, can be precipitated onto the "naked" core particles.

For that purpose addition homopolymer or copolymers may be used, e.g. any vinylic or acrylic homo- or copolymer that is soluble in aqueous alkaline medium, e.g. as ammonium salt, but becomes insoluble by dropping the pH. These polymers are in principle equivalent to the water-soluble stabilizing (co)polymers, described above, and are chosen, not so much on the basis of stabilizing action, but on the basis of properties directly relating to the qualities of toner resins.

When applying a shell or external layer of (a) polymer(s) the polymer composition of said layer has a glass transition value (Tg value) larger than 50° C., and a softening temperature lower than 170° C., preferably in the range of 120° to 140° C. enabling relatively easily fusing e.g. with radiant heat or contact with hot roller of said composition. When the Tg is lower than the indicated value conglomeration of the toner particles and caking (sticking together) may take place resulting in inferior developing results. A too high softening temperature will give rise to insufficiently fixed (adherent) toner images.

It is advantageous to have in the shell polymer(s) as few as possible ionic groups that have high dissociation capability in aquous medium, viz. salt groups, because they are too rapidly increasing the sensitivity of the triboelectrical charge to changes in relative humidity.

Addition copolymers of the following list A can be used advantageously for obtaining a hydrophobic shell material with indicated Tg and softening temperature controlled by molecular weight.

List A co(styrene/acrylic acid), co(styrene/ethylmaleate/maleic acid); co(styrene/n-butylmaleate/maleic acid), co(vinylacetate/crotonic acid), and co(vinylacetate/crotonic acid/methylmethacrylate).

The molecular weight of said polymers is directly proportional to the viscosity obtained therewith in aqueous ammonia medium. Useful results are obtained with polymer that in 10% by weight solutions in aqueous ammonia medium have a viscosity at 20° C. in the range of 25 to 150 cP. Total acid numbers of said polymers are preferably in the range of 50 to 500, and their melting range comprising their softening temperature is preferably from 110° to 170° C.

Preferably an unmodified addition copolymer of styrene/maleic acid and a partial ester thereof, e.g. mono-ethyl- or n-butyl ester is used. The amount of maleic acid determines the balance between solubility in alkali and the hydrophobicity.

Such addition copolymer exhibits enough solubility in alkaline aqueous solution thereof which solution is mixed with the initially obtained toner-resin containing particles (core particles) and the addition copolymer is precipitated thereon as a shell by acidifying the solution. An analogous technique is described in U.S. Pat. No. 4,904,562. In ammoniacal aqueous medium the maleic acid units form with ammonia ($NH_3$) and likewise with primary amines ($R\text{-}NH_2$) through imidization a ring-closed ureido structure (—CO—NH—CO—).

Instead of using a (co)polymer that becomes soluble in alkaline aqueous medium and insoluble in aqueous acidic medium, to form a shell on the "naked" core particles, a (co)polymer may be used (e.g. containing amino groups) that becomes soluble in acidic medium and precipitates in alkaline medium. Suitable copolymers containing amino groups in their backbone structure are listed in the already mentioned Table 1.

The precipitation of the polymers, cited above, on the core particles, according to the present invention, can easily change the chargeability of the core particle by the choice of the amount of acidic groups comprised in the polymer that is precipitated on the "naked" core particles, prepared according to the present invention.

According to another technique for precipitating a polymeric shell on "naked" core particles, the initially obtained "naked" particles serving as core particles contain as toner-resin a polymer having free acid groups (e.g. non-esterified acid groups of a polyester) and said core particles are allowed to react in dispersed state at their surface with free amino groups of a dissolved shell-forming polymer which may be a copolymer containing amino groups as presented in the already mentioned Table 1. By that reaction amine salt groups are formed that may improve positive triboelectric chargeability of the toner particles.

According to an alternative technique for precipitating a polymeric shell on a toner core particle, the initially obtained core particles contain as toner-resin a polymer having free amino groups and said core particles are allowed to react in dispersed state at their surface with a dissolved shell-forming polymer or (co)polymer having free acid groups.

According to still another technique needing no pH-adjustment for producing a polymeric shell, the initially obtained core particles contain as toner-resin a polymer having free amino groups, and/or hydroxyl groups, that may be phenolate groups. Suited amino group-containing polymers are those listed in Table 1. Suitable hydroxyl group-containing polymers are slightly saponified polyvinylacetate and polyesters having unreacted hydroxyl or phenolate groups. Said core polymers after having been freed from their organic solvent are allowed to react in dispersed state in aqueous medium at their surface with at least one water-soluble polymer containing reactive halogen, e.g. water-soluble (co)polymers including copolymerized vinylbenzyl chloride or β-chloroethyl acrylate as described e.g. in U.S. Pat. No. 3,708,289.

Liquid toner developers in which coatings of toner particles are linked chemically to core particles are described in U.S. Pat. No. 4,663,265 whereto reference is made for exemplifying chemical reactions useful for chemically linking core and shell polymers in toner particles of the present invention.

The thickness of the shell of precipitated or chemically reacted polymer may range from 20 nm to 1000 nm, but is preferably between 50 and 250 nm.

The composition of the surface of the triboelectric partner (e.g. carrier particles) used in frictional contact with the toner particles and the kind of resin(s) contained in the toner particles and or forming their surface together with the colorant(s) and optional charge controlling agent(s) determine the net charge sign and charge height acquired by the toner particles.

Triboelectric chargeability of toner-carrier pairs can be properly determined using the triboelectric series given in the periodical PHYSICS TODAY/May 1986, p. 51.

Carrier particles suitable for use in cascade or magnetic brush development are described e.g. in GB-B 1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 82 m. The carrier and more preferably in the range of 50 to 300 μm. The carrier particles possess sufficient density and inertia to avoid adherence to the electrostatic charge images during the development process. The carrier particles can be mixed with the toner particles in various ratios, best results being obtained when about 1 part by weight of toner is mixed with about 10 to 200 parts of carrier. The shape of the carrier particles, their surface coating and their density determines their flow properties.

Easily flowing carrier particles with spherical shape can be prepared according to a process described in GB-B 1,174,571.

Very suitable carrier particles are describe in e.g. U.S. Pat. No. 4,879,198 and U.S. Pat. No. 5,336,580. The carrier particles have preferably an electric resistivity between $10^7$ and $10^{14}$ ohm.cm, and this resistivity is adjusted by the choice of the type and thickness of the polymer coating of the carrier particles.

The present invention is not limited to the production of two-component toners but is directed as well to the production of triboelectrically chargable mono-component toners applied without carrier particles.

The following examples illustrate the present invention, but are not limitative thereto. All percentages, parts and ranges are by weight unless mentioned otherwise.

EXAMPLE 1

1. Preparation of an aqueous solution of co(styrene-maleic acid) (50/50) (solution A) serving for use in emulsion stabilization A 10% aqueous solution of co(styrene-maleic acid) (50/50 mole ratio) being for the larger part in ammonium salt form (pH =6) and having at 20° C. a viscosity of 120 mPa.s. From this solution 1400 g are added to 8600 g of distilled water is brought with acetic acid to DH 4.5. The diluted mixture has at 20° C. a viscosity of 5.6 mPa.s. That solution is called solution A and contains the dispersion stabilizer for the emulsion droplets of solution B.

2. Preparation of organic polyester solution (solution B)

2000 g of ATLAC T500 (ATLAC is a registered trade name of Atlas Chemical Industries Inc. Wilmington, Del. U.S.A. for a linear polyester of fumaric acid and propoxylated bisphenol A) was stirred into 8000 g of ethyl acetate at room temperature. The introduction of said polyester into the ethyl acetate proceeded in very small portions at the time. The viscosity of the obtained solution, being solution B, was 5 mPa.s at 20° C.

3. Preparation of predispersion C 900 g of said solution A and 600 g of said solution B were mixed in a 2-liter polypropylene recipient under constant stirring with magnetic stirrer.

The predispersion C is completed in a bottle moved on a roller-table for 45 minutes.

4. Emulsion preparation

A first part of 0.5 liter of the predispersion C was brought into a supply vessel, and pumped therefrom into the mixing chamber of a COBAL MILL MS12 (tradename for a high shear mixing apparatus sold by Fryma Maschinen AG, Rheinfelden, Germany). At the end of the introduction of the predispersion into the mixing chamber, the pump was desactivated and the rotor activated to make 1200 rpm for 15 s. During that period the remaining part of the predispersion C was brought into the supply vessel. After 15 s the pump was reactivated at a pumping rate of 760 ml/min and the rotor of the mixing chamber kept rotating. Once the supply vessel became empty the pump was desactivated but the rotor in the mixing chamber kept stirring for still 15 sec.

5. Solvent evaporation

The organic solvent, viz. the ethyl acetate, of the obtained emulsion droplets was evaporated at 50° C. under reduced pressure (about 50 kPa), while blowing air over the emulsion at that pressure to take away the solvent vapour. After about 8 hours the evaporation was completed and a dispersion of stabilized solid polymer particles in water was obtained. At this moment it is possible to measure average particle size and size distribution.

6. Washing the dispersion stabilizer away

The dispersion of particles was divided in recipients for fitting in a SORVALL RC2B (tradename of DUPONT—USA) sedimentation centrifuge and was centrifuged at 2000 rpm for 20 min. The supernatant fluid was decanted, and the sediment was washed with water. The supernatant liquid was flushed away with water. Thereupon, 100 ml of demineralized water were added and the suspension agitated with stirring rod. The sediment was then dispersed again in water an placed in an ultrasonic bath for 15 min, centrifuged at 4000 rpm, decanted and the sediment washed again with water. This procedure was repeated 3 times.

Drying of the particles proceeded for 3 h in a MUNTERS LK (tradename of AB CALL Munters Torkan—Sweden) air stream dryer operating with air at 40° C.

The dry paste was introduced into a J+K mill (IKA NIVERSALMUHLE M20, tradename), 0.5% by weight of hydrophobic silica with BET surface of 260 $m^2/g$ (AEROSIL R812, tradename of Degussa, Germany) and sieved over a sieve of 40 μm hole diameter, giving toner particles 1 (TP1.)

From the bulk of toner particles having passed through the sieve the size distribution was measured using a COULTER COUNTER Type TA II/PCA1, model available frommthe Coulter Electronics Corp., Nortwell Drive, Luto, Bedfordshire, LV 33 R4, U.K. Measured were the average particle size by volume (dv), the average size by number (dn) presented in the following Table 2.

The toner charge after triboelectric contact with a coated ferrite carrier particles having a diameter of about 55 μm was measured with a commercial q/m-meter. The triboelectric charging was carried out with a toner concentration of 3% on the total toner-carrier mixture. The result of said charge measurement expressed in μC/g is given Table 2 hereinafter. This charge was compared to the charge of toner particles with the same toner resin and ingredients as TP1, but prepared by a classical melt-kneeding method (TP2). From these values it can be seen that the chargeability of the two toners is equivalent and that thus the polymeric stabilizer is totally washed away in a fairly simple washing step. In an alternative the stabilizer was not washed away, but precipitated onto the particles by introducing after step 5 an acidifying step and then drying the particles, giving particles TP3. The particles size and the chargeability was measured as explained above and are mentioned in table 2. It is clear that by simply precipitating the stabilizing (co)polymer onto the particles the surface properties can largely be changed.

TABLE 2

| Particle | μC/g | dv in μm | dn in μm |
|---|---|---|---|
| TP1 | −22.0 | 6.8 | 4.00 |
| TP2 | −23.5 | 6.7 | 4.15 |
| TP3 | −7.4 | 6.8 | 4.10 |

EXAMPLE 2

Coating of the washed polyester-type toner particles with an envelope of addition polymer Preparation of coating solution S 15 g of SMA3000 (is a registered trademark of ATOCHEM North America. Inc) resin being a copolymer of styrene and maleic anhydride containing styrene units in a proportion of 3 with respect to maleic anhydride units in the number of 1, having a melting range of 115 to 130° C., acid number 280 and viscosity at 30° C. of 15% aqueous solution of 26 mPa.s, were brought into 1 liter of demineralized water. During continuous stirring 10 g of a 25% aqueous ammonia solution were added. The mixture was brought to a temperature of 70° C. to obtain complete dissolution whereupon it was cooled down again to room temperature (20° C.).

Preparation of toner dispersion T

In demineralized water being alkalinized with ammonia up to pH 8 a 10% dispersion was made of the by sieve selected toner particles of example 1 (TP1).

Enveloping step

Under stirring 1 liter of the 10% particle dispersion of TP1 was mixed with 1 liter of coating solution S and the obtained dispersion was acidified with acetic acid up to a pH 4.

The dispersion of particles was divided in recipients for fitting in a SORVALL RC2B (tradename of DUPONT—USA) sedimentation centrifuge and was centrifuged at 5000 rpm for 20 min. The supernatant fluid was decanted, and the sediment was washed with water. The supernatant liquid was flushed away with water. Thereupon, 100 ml of demineralized water were added and the suspension agitated with stirring rod. The sediment was then dispersed again in water an placed in an ultrasonic bath for 15 min, centrifuged at 5000 rpm, decanted and the sediment washed again with water. This procedure was repeated 3 times.

Drying of the particles proceeded for 3 h in a MUNTERS LK (tradename of AB CALL Munters Torkan—Sweden) air stream dryer operating with air at 40° C.

The dry paste was introduced into a J+K mill (IKA UNIVERSALMUHLE M20, tradename) for 20 sec treating the particles and mixing with 0.5% hydrophobic silica with BET surface of 260 $m^2/g$ (AEROSIL R812, tradename of Degussa, Germany) to improve the flow of the dried toner powder, which after passing a wind sifter was sieved over a sieve of 40 μm hole diameter (TP4).

From the bulk of toner particles having passed through the sieve the size distribution and toner charge were measured as described above under step 6.

The measurement results are presented in the following Table 3.

TABLE 3

| Particle | μC/g | dv in μm | dn in μm |
|---|---|---|---|
| TP4 | −16.0 | 7.05 | 4.7 |

We claim:

1. A method for producing dry toner particles comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized, in the absence of silica, by the presence in the said aqueous phase of a dissolved water-soluble (co)polymer, comprising hydrophobic and hydrophilic moieties and that II. after evaporation of said solvent said water-soluble (co)polymer is washed away.

2. A method according to claim 1, wherein said water-soluble (co)polymer comprises either carboxylic acid groups or sulphonic acid groups or both in acid or salt form.

3. A method according to claim 1, wherein said water-soluble (co)polymer is a copolymer of at least one addition polymerizable hydrophobic monomer and at least one addition polymerizable ionic monomer.

4. A method according to claim 3, wherein said addition polymerizable ionic monomer is an unsaturated monocarboxylic acid selected from the group consisting of acrylic acid, methacrylic acid and crotonic acid or an unsaturated dicarboxylic acid selected from the group consisting of maleic acid, fumaric acid, itaconic acid and citraconic acid, the anhydride of these acids, the half-esters of these acids and the half amines of these acids.

5. A method according to claim 3, wherein said addition polymerizable hydrophobic monomer is selected from the group consisting of styrene, vinylacetate, methytacrylate and methylmethacrylate.

6. A method according to claim 3, wherein said water-soluble (co)polymer is co(vinylacetate/ammoniumcrotonate) (90/10 by weight), or co(styrene/ammoniummaleate) (50/50 by weight).

7. A method according to claim 1, wherein said water-soluble (co)polymer is a polycondensation polymer comprising either carboxylic acid or sulphonic acid groups or both.

8. A method according to claim 2, wherein said water-soluble (co)polymer comprises carboxyl groups in the form of an ammonium salt or in the form of the salt of a C1 to C4 tertiair amine.

9. A method according to claim 1, wherein said organic polymer (toner resin) is an addition homo- or copolymer of olefinic or acrylic monomers or mixtures that can be dissolved in water-immiscible solvent(s).

10. A method according to claim 1, wherein said organic polymer (toner resin) is a silicone resin, a polycondensation polymer, or a polyester being a linear polycondensation product of (i) at least one difunctional organic acid and (ii) at least one organic dihydroxy compound.

11. Method according to claim 1, wherein the average size of the prepared toner particles (on weight base) is between 3 μm and 10 μm and where the particle size distribution is basically Gaussian with a variation coefficient of the distribution (standard deviation/average particle size) lower than 0.4.

12. A method for producing dry toner particles comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized by the presence in the said aqueous phase of a dissolved water-soluble (co)polymer, comprising hydrophobic and hydrophilic moieties and that II. after evaporation of said solvent said water-soluble (co)polymer is at least partially transformed to a water-insoluble compound and is precipitated onto said solid polymeric particles.

13. A method according to claim 12, wherein said water-soluble (co)polymer comprises either carboxylic acid groups or sulphonic acid groups or both in acid or salt form.

14. A method according to claim 12, wherein said water-soluble (co)polymer is a copolymer of at least one addition polymerizable hydrophobic monomer and at least one addition polymerizable ionic monomer.

15. A method according to claim 14, wherein said addition polymerizable ionic monomer is an unsaturated monocarboxylic acid selected from the group consisting of acrylic acid, methacrylic acid and crotonic acid or an unsaturated dicarboxylic acid selected from the group consisting of maleic acid, fumaric acid, itaconic acid and citraconic acid, the anhydride of these acids, the half-esters of these acids and the half amines of these acids.

16. A method according to claim 14, wherein said addition polymerizable hydrophobic monomer is selected from the group consisting of styrene, vinylacetate, methylacrylate and methylmethacrylate.

17. A method according to claim 14, wherein said water-soluble (co)polymer is co(vinylacetate/ammoniumcrotonate) (90/10 by weight), or co(styrene/ammoniummaleate) (50/50 by weight).

18. A method according to claim 12, wherein said water-soluble (co)polymer is a polycondensation polymer comprising either carboxylic acid or sulphonic acid groups or both.

19. A method according to claim 13, wherein said water-soluble (co)polymer comprises carboxyl groups in the form of an ammonium salt or in the form of the salt of a C1 to C4 terriair amine.

20. A method according to claim 12, wherein said organic polymer (toner resin) is an addition homo- or copolymer of olefinic or acrylic monomers or mixtures that can be dissolved in water-immiscible solvent(s).

21. A method according to claim 12, wherein said organic polymer (toner resin) is a silicone resin, a polycondensation polymer, or a polyester being a linear polycondensation product of (i) at least one difunctional organic acid and (ii) at least one organic dihydroxy compound.

22. Method according to claim 12, wherein the average size of the prepared toner particles (on weight base) is between 3 μm and 10 μm and where the particle size distribution is basically Gaussian with a variation coefficient of the distribution (standard deviation/average particle size) lower than 0.4.

23. A method according to claim 12, wherein said water-soluble copolymer is at least partially transformed to a water-insoluble compound by changing the pH.

24. A method according to claim 12, wherein said water-soluble copolymer is at least partially transformed to a water-insoluble compound by the addition of at least one multi-valent anorganic or organic cation.

25. A method according to claim 24, wherein said water-soluble (co)polymer is at least partially transformed to a water-insoluble compound and is precipitated onto said solid polymeric particles and further transformed to a water-insoluble compound during the drying of said solid polymeric particles by evaporation of volatile basic compounds, present in said water-soluble (co)polymer.

26. A method for producing dry toner particles comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized by the presence in the said aqueous phase of a dissolved water-soluble (co)polymer, comprising hydrophobic and hydrophilic moieties and that II. after evaporation of said solvent said water-soluble (co)polymer is washed away and III. at least one polymer that differs in composition from the organic polymer(s) of said solid particles and provides to said particles serving as core particles a polymeric shell or envelope the polymer composition of which has a glass transition point (Tg) larger than 50° C. and a softening temperature smaller than 160° C., is precipitated onto said solid particles.

27. A method according to claim 26, wherein said water-soluble (co)polymer comprises either carboxylic acid groups or sulphonic acid groups or both in acid or salt form.

28. A method according to claim 26, wherein said water-soluble (co)polymer is a copolymer of at least one addition polymerizable hydrophobic monomer and at least one addition polymerizable ionic monomer.

29. A method according to claim 28, wherein said addition polymerizable ionic monomer is an unsaturated monocarboxylic acid selected from the group consisting of acrylic acid, methacrylic acid and crotonic acid or an unsaturated dicarboxylic acid selected from the group consisting of maleic acid, fumaric acid, itaconic acid and citraconic acid, the anhydride of these acids, the half-esters of these acids and the half amines of these acids.

30. A method according to claim 28, wherein said addition polymerizable hydrophobic monomer is selected from the group consisting of styrene, vinylacetate, methylacrylate and methylmethacrylate.

31. A method according to claim 28, wherein said water-soluble (co)polymer is co(vinylacetate/ammoniumcrotonate) (90/10 by weight), or co(styrene/ammoniummaleate) (50/50 by weight).

32. A method according to claim 26, wherein said water-soluble (co)polymer is a polycondensation polymer comprising either carboxylic acid or sulphonic acid groups or both.

33. A method according to claim 27, wherein said water-soluble (co)polymer comprises carboxyl groups in the form of an ammonium salt or in the form of the salt of a C1 to C4 terriair amine.

34. A method according to claim 26, wherein said organic polymer (toner resin) is an addition homo- or copolymer of olefinic or acrylic monomers or mixtures that can be dissolved in water-immiscible solvent(s).

35. A method according to claim 26, wherein said organic polymer (toner resin) is a silicone resin, a polycondensation polymer, or a polyester being a linear polycondensation product of (i) at least one difunctional organic acid and (ii) at least one organic dihydroxy compound.

36. Method according to claim 26, wherein the average size of the prepared toner particles (on weight base) is between 3 μm and 10 μm and where the particle size distribution is basically Gaussian with a variation coefficient of the distribution (standard deviation/average particle size) lower than 0.4.

* * * * *